US007014335B2

(12) United States Patent
Probst et al.

(10) Patent No.: US 7,014,335 B2
(45) Date of Patent: Mar. 21, 2006

(54) FLASHLIGHT WITH WAVE SPRING ELECTRICAL CONNECTION

(75) Inventors: Brian E. Probst, Renovo, PA (US); Joseph E. Gorrie, Klingertown, PA (US)

(73) Assignee: W.T. Storey, Inc., Dalmatia, PA (US)

( * ) Notice: Subject to any disclaimer, the term of this patent is extended or adjusted under 35 U.S.C. 154(b) by 0 days.

(21) Appl. No.: 10/792,045

(22) Filed: Mar. 3, 2004

(65) Prior Publication Data

US 2005/0195595 A1 Sep. 8, 2005

(51) Int. Cl.
*F21L 4/04* (2006.01)

(52) U.S. Cl. ..... 362/202; 362/203; 362/184; 362/158; 362/208

(58) Field of Classification Search ..... 362/202, 362/197, 187, 188, 205, 203, 208, 184, 800, 362/158

See application file for complete search history.

(56) References Cited

U.S. PATENT DOCUMENTS 4,876,632 A 10/1989 Osterhout et al.
4,899,265 A * 2/1990 Maglica ..... 362/187
5,630,661 A 5/1997 Fox
5,660,458 A 8/1997 Chabria
5,871,272 A 2/1999 Sharrah et al.
5,909,062 A 6/1999 Krietzman
5,957,567 A 9/1999 Kish et al.
6,046,572 A 4/2000 Matthews et al.
6,095,661 A 8/2000 Lebens et al.
6,170,960 B1 1/2001 Maglica
6,366,028 B1 4/2002 Wener et al.
6,386,730 B1 5/2002 Matthews
6,398,383 B1 * 6/2002 Huang ..... 362/202
6,428,182 B1 8/2002 Maglica
6,485,160 B1 11/2002 Sommers et al.
6,626,556 B1 * 9/2003 Galli ..... 362/205
6,722,772 B1 * 4/2004 Maglica ..... 362/197
6,805,461 B1 * 10/2004 Witte ..... 362/169

* cited by examiner

*Primary Examiner*—Thomas M. Sember
(74) *Attorney, Agent, or Firm*—Thomas R. Shaffer, Esq.

(57) ABSTRACT

A flashlight having a flashlight head and an electrically conducting battery chamber battery chamber is provided. The flashlight head has a light emitting object positioned therein and the battery chamber is adapted to be removably attached to the flashlight head. The battery chamber is also adapted to receive and make an electrical connection with at least one cell. A wave spring is positioned between said electrically conducting battery chamber and the flashlight head and the wave spring is at least partially compressed when the battery chamber is attached to the flashlight head. An electrical connection is made between the cell positioned in the battery chamber and the light emitting object through said wave spring.

22 Claims, 4 Drawing Sheets

FLASHLIGHT WITH WAVE SPRING ELECTRICAL CONNECTION

BACKGROUND OF THE INVENTION

1. Field of the Invention

The present invention relates to a flashlight having a flashlight head and an electrically conducting battery chamber. More specifically, it relates to a flashlight which provides a wave spring to make an electrical connection between the battery chamber and the flashlight head.

2. Description of the Prior Art

A variety of flashlights are known in the art. The method used by many flashlight manufacturers to complete an electrical circuit is as follows. The batteries are inserted into a tube like battery chamber which is typical either completely formed of an electrically conducting metal or has a conducting member provided therein to provide an electrical connection from a negative terminal to the flashlight head. The flashlight head is also either completely formed of an electrically conducting metal or has a conducting member provided therein to provide an electrical connection from a negative terminal to a light emitting element. If the tube like chamber is permanently connected to the flashlight head then a cap is screwed onto the chamber. In some cases the chamber is closed at one end and the chamber itself is screwed into the flashlight head. In either case, the threaded portions of both metal pieces (the chamber and the head) are used to make an electrical connection. Because of variations between minor and major diameter threads of the two mating surfaces and intermittent connection may result causing the light to flicker. Such a connection is believed to be unreliable and an improved design is needed.

SUMMARY OF THE INVENTION

The present invention provided a high tech flashlight that is intended to serve fire fighting personnel, law enforcement personnel, emergency management services personnel and civilians alike. The flashlight preferably features a high intensity white LED light source that is powered by a pair of "AA" cells, although any type of light emitting element may be used with any type or number of battery cells. The housing for the flashlight head is preferably made from an electrically insulating material such as a high strength polycarbonate material but may alternatively be fabricated from stainless steel, aluminum or any other electrically conducting material. The switch is preferably hermetically sealed to enable the unit to be water resistant. The flashlight is preferably sealed with one or more O-rings to make the flashlight water resistant.

The present invention provides unique way of making electrical contact and a reliable electrical connection between the battery cells and a circuit which is electrically connected to the light emitting element. The flashlight preferably has a removable battery chamber made of metal but covered with a rubber like material to add comfort to the user. The metal battery chamber tube is closed at one end and will be electrically connected to the negative side of the battery cells by using a conical spring. The open end of the battery chamber is threaded and also has an O-ring to keep the flashlight water tight when assembled. The threaded portion of the battery chamber also has a flange to prevent the chamber from being inserted too far into the flashlight head. Once the battery cells are inserted into the chamber, the chamber is then threaded into the flashlight head. Since the flashlight head is preferably made of polycarbonate, the electrical circuit cannot be completed using the same method as previously stated and used by many flashlights. Rather, inside of the flashlight head is nested a metal wave spring and a metal ring which is also connected electrically to the circuit board. Since the metal ring and the metal wave spring are in constant contact, this also makes the metal wave spring connected electrically to the circuit board. The inside and outside diameters of the wave spring closely match that of the battery chamber. The wave spring preferably has a travel height of 0.060". When the battery chamber is attached to the flashlight head, there is no electrical connection until the battery chamber tube makes contact with the wave spring. The metal tube will make contact with the wave spring just before the flange on the tube bottoms out on the flashlight head. The wave spring will then become at least partially compressed. This compression of the wave spring and resulting spring force insures a reliable electrical connection between the battery chamber tube and the circuit board.

If the flashlight head is made of an insulating material (as is preferred) the wave spring an absolutely essential element in forming an electric circuit. If the flashlight head is made of an electrically conducting material then an electric circuit will be formed (although not reliably formed) by the threaded connection between the flashlight head and the battery chamber in the same manner as in prior art designs. In this case, the wave spring acts to provide an additional more reliable connection by means of the compressed wave spring storing energy which consistently exerts force on both a metal washer connected to the light emitting element and on the battery chamber.

In its simplest form, the present invention provides a flashlight having a flashlight head having a light emitting object positioned therein; an electrically conducting battery chamber adapted to be removably attached to said flashlight head, said battery chamber adapted to receive and make an electrical connection with at least one cell; and a wave spring positioned between said electrically conducting battery chamber and said flashlight head whereby said wave spring is at least partially compressed when said battery chamber is attached to said flashlight head and an electrical connection is made between said at least one cell positioned in said battery chamber and said light emitting object through said wave spring.

The flashlight head includes a reflector. The light emitting object may be an incandescent bulb but is preferably a solid state device in the form of a light emitting diode (LED), preferably a high intensity white LED light source. Although one LED is preferred the present invention may include plural light sources.

Preferably, the battery chamber preferably makes an electrical connection with a negative terminal of a cell through a negative terminal coil spring positioned in said electrically conducting battery chamber.

Preferably, the flashlight head further comprises a positive terminal coil spring located in a central portion thereof, said positive terminal coil spring making an electrical connection between a positive terminal of a cell positioned in said battery chamber and said light emitting object.

Preferably, said flashlight head said battery chamber are each threaded and said flashlight head is removably attached to said battery chamber by screwing the flashlight head to the battery chamber. Alternatively, the flashlight head is removably attached to said battery chamber by means of a push and twist telescoping latch mechanism.

Preferably, the flashlight further includes metal ring member electrically connected to said light emitting object and in electrical contact with said wave spring.

Preferably, the flashlight further includes a circuit board member electrically connected to said light emitting object and in electrical contact with said wave spring. Said circuit board member is preferably electrically connected to said light emitting object and is connected to a negative terminal of a cell in said battery chamber through said wave spring. Preferably, said circuit board member is electrically connected to a positive terminal of a cell in said battery chamber through a coil spring and said circuit board member provides a constant current to said light emitting object.

An O-ring is preferably provided between said battery chamber and said flashlight head to provide a water resistant seal. A flange is preferably provided on said battery chamber to prevent said chamber from being inserted to far into the flashlight head when attached thereto.

DETAILED DESCRIPTION OF THE PREFERRED EMBODIMENTS

Figure 1:
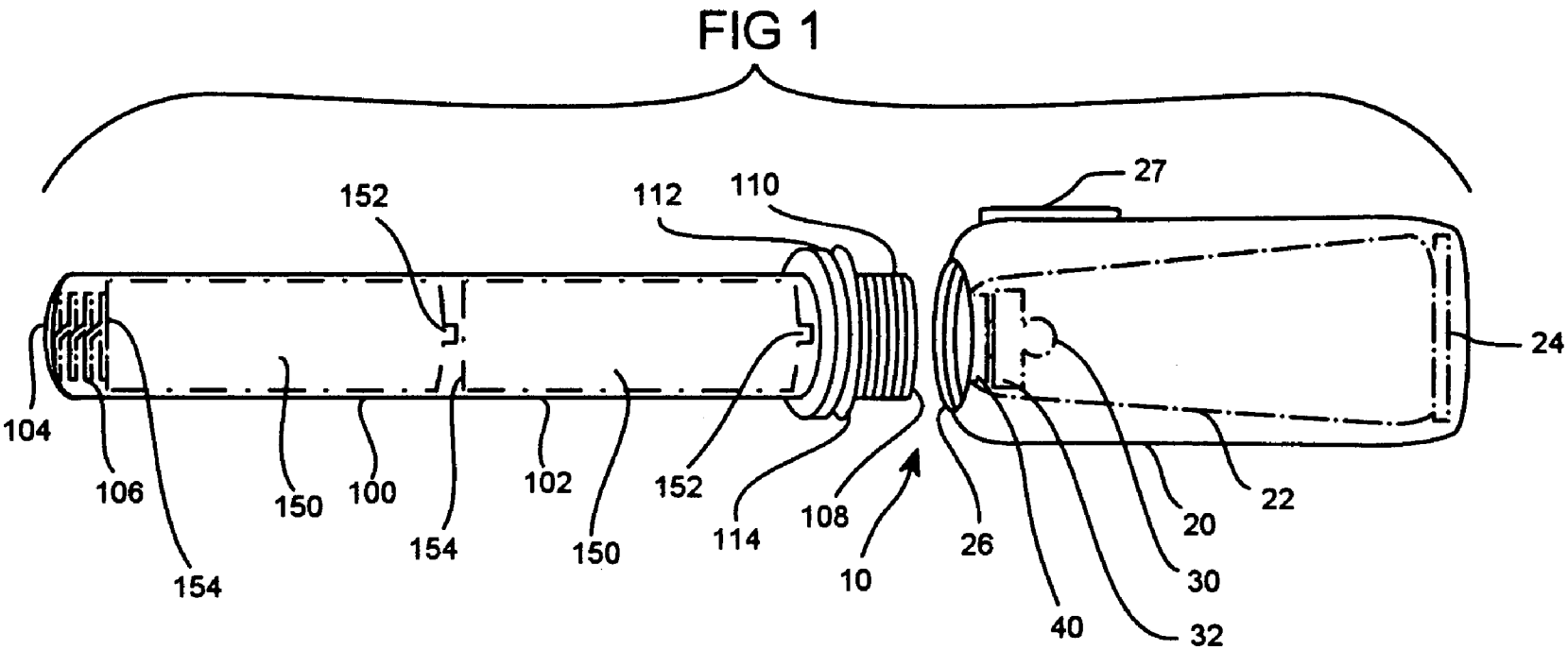
FIG. 1 is a side elevational view showing the flashlight head and the tubular battery chamber.

Referring to FIG. 1, the flashlight 10 of the present invention preferably includes a flashlight head 20 which is adapted for attachment to a tubular battery chamber 100. The battery chamber 100 has a cylindrical wall 102 having a closed end 104. A coil spring 106 is provided in closed end 104. An open end 108 is provided which is threaded with threads 110. Open end 108 includes a shoulder 112 onto which an O-ring 114 is attached.

The flashlight head 20 includes a reflector 22, a front lens 24 and a threaded opening 26. A switch 27 is provided to turn the flashlight on and off. A light emitting element 30 which is preferably in the form of a bright light LED is provided. The light emitting element 30 is attached to a heat sink 32 which is attached by spacers 34 to a circuit board 40. Spacers 44 keep the circuit board 40 spaced from a metal ring 50. The metal ring 50 is in intimate contact with a wave spring 60. A cylindrical housing 70 is provided which has a housing head 74 which telescopes longitudinally within cylindrical housing 70. A coil spring 74 is provided within cylindrical housing 70. The coil spring 74 has an end 76 which is adapted to make contact with a positive lead 152 of a battery cell 150 which is provided in the battery housing 100. As shown in FIG. 1, the battery housing is preferably adapted to receive two battery cells 150. Alternatively, a single cell may be utilized. With modifications well known in the art, any type of battery cell may be utilized to power the light emitting element 30.

Figure 2:
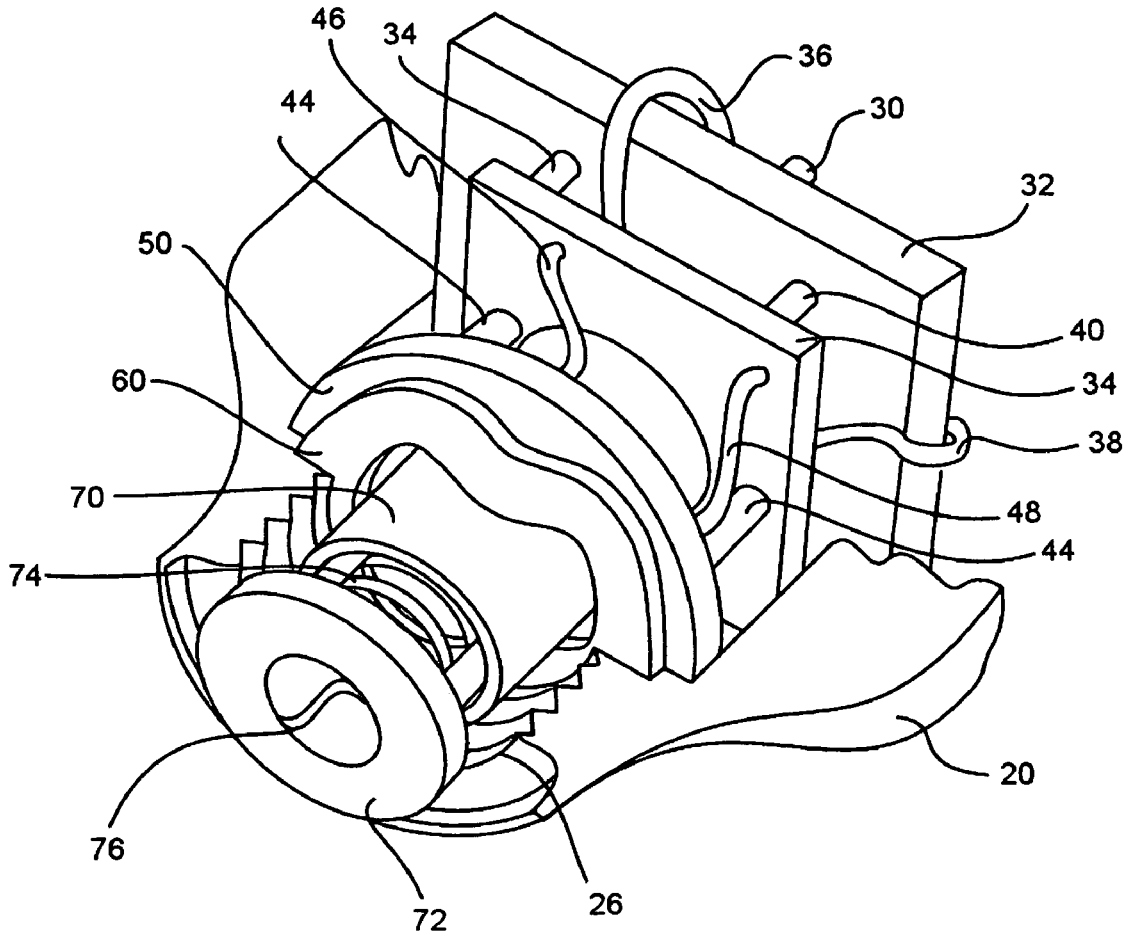
FIG. 2 is a perspective view, partly in section showing the flashlight head.

Referring specifically to FIG. 2, the electrical connections of the battery to the light emitting element 30 will be described. First, a connection of the light emitting element 30 to the negative terminal 154 of the battery cells 150 will be described. As shown in FIG. 1, the negative terminal 154 of battery 150 is in electrical contact with coil spring 106. Because the battery housing 100 is fabricated of an electrically conducting material, this provides a negative charge on the threaded end 108 of the battery chamber 100. Referring now to FIG. 2, threaded end 108, when screwed onto the flashlight head 20, makes an electrical connection with wave spring 60. Wave spring 60 in turn is in electrical contact with metal ring 50. Metal ring 50 is connected to the circuit board by wire 48 and the negative terminal of the circuit board is connected directly to the light emitting element 30 by wire 38.

Referring now to the connection to the positive terminal 152 of the battery cells 150 it can be seen that said positive terminal 152 is adapted to contact end 76 of coil spring 74 of cylindrical housing 70. The opposite end of coil spring 74 is attached by wire 46 to the circuit board 40. The circuit board 40 is in turn connected to the light emitting element by wire 36 thus completing the electrical connection from the lighting element to the positive terminal.

Figure 3:
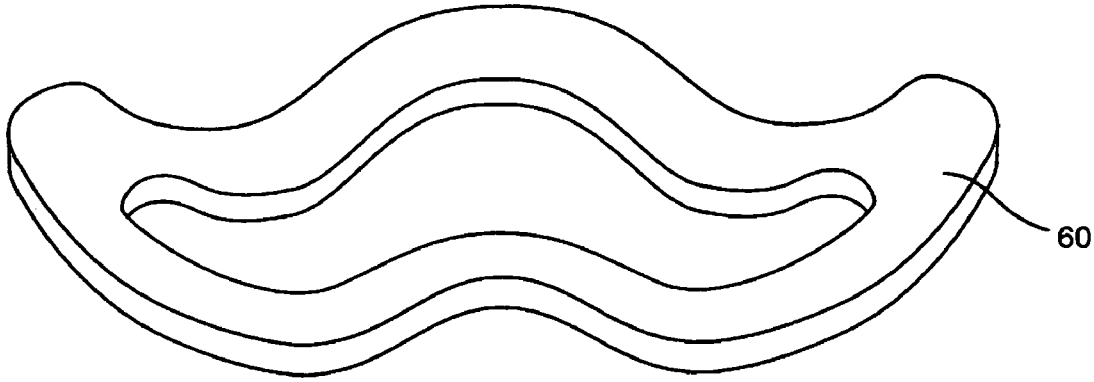
FIG. 3 is a perspective view of the wave spring of the present invention.
Figure 4:
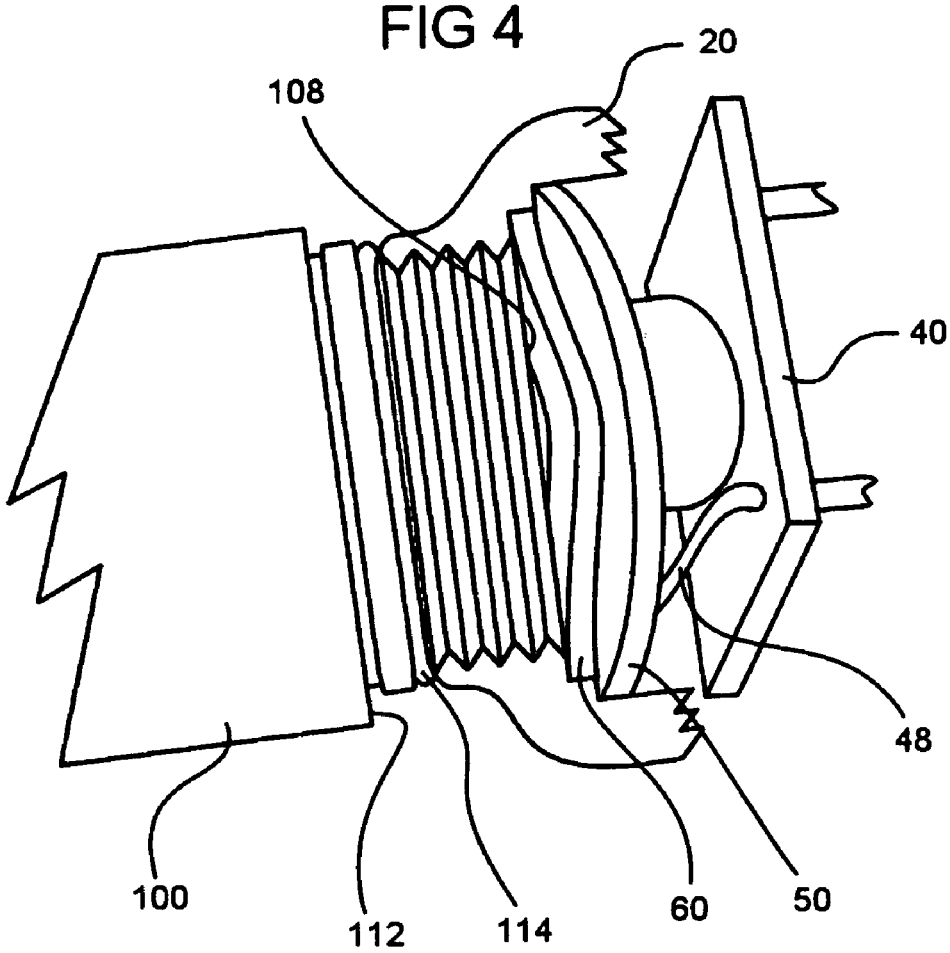
FIG. 4 is a cross sectional view of the flashlight head as attached to the battery chamber.

It will be understood by reference to FIG. 3 that when the flashlight head is fully screwed onto the battery chamber 100, the undulating waves of the coil spring 60 are at least partially compressed. This compression of the wave spring causes the wave spring to store energy and to keep pressure and a constant connection between the end 108 of the battery chamber 100 and the metal ring 50 between which the wave spring 60 is compressed. As can be seen from FIG. 3, wave spring 60 is annular in shape and is formed to have plural crests 61 and valleys 62. As is obvious from the Figures, these crests 61 and valleys 62 form multiple contact points where an electrical connection is formed. This relationship showing the compression of the wave spring 60 is best shown in FIG. 4.

Figure 5:
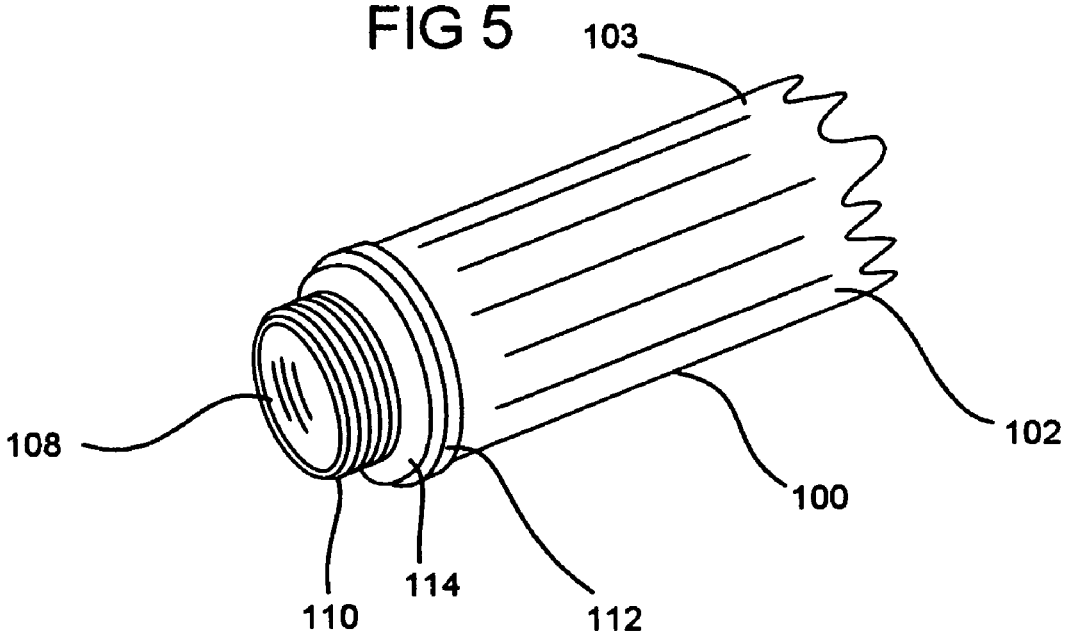
FIG. 5 is a perspective view of a threaded end of the battery chamber.

FIG. 5 shows that the cylindrical wall 102 of the battery chamber 100 is preferably coated with a rubberized coating 103 to make a more comfortable grip for the user. Further, FIG. 5 shows the location of an O-ring 114 which creates a waterproof seal. Shoulder 112 is provided to prevent the flashlight battery chamber 100 from being screwed too far into the flashlight head 20.

Figure 6:
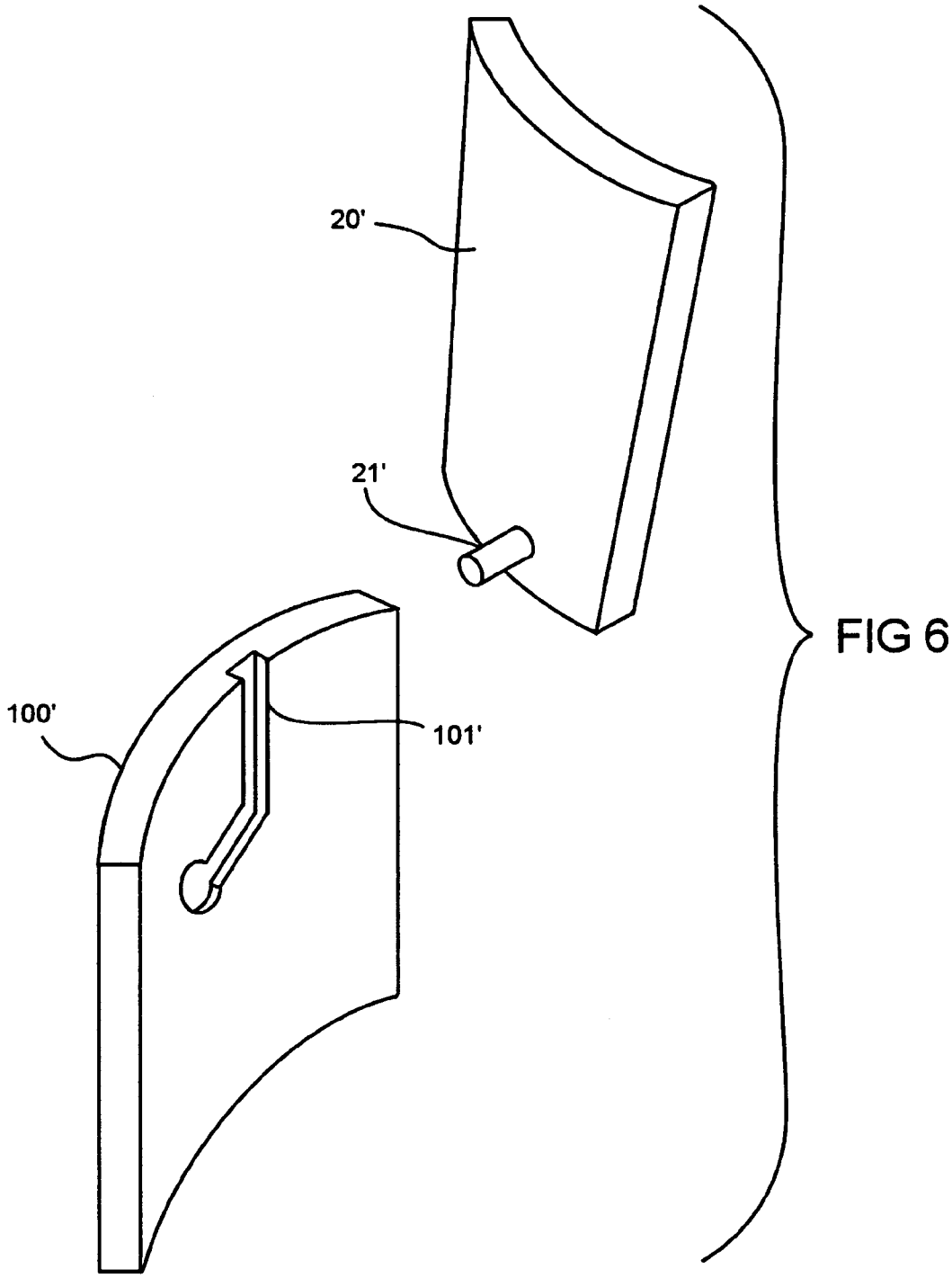
FIG. 6 shows an alternative embodiment of the invention having a push and twist telescoping latch mechanism.

FIG. 6 shows an alternative method of attaching the flashlight head to the battery chamber. In FIG. 6, a portion of the flashlight head is designated as element 20 prime and a portion of a battery chamber is shown as element 100'. The flashlight head 20' is provided with a post 20' which is adapted to be received by groove 101' in the battery chamber 100'. It will be obvious that this is a standard push and twist telescopic lack mechanism. While this method is not preferred, it will be obvious to those skilled in the art that it is an alternative method of making a connection which would still cause at least a partial compression of the wave spring.

While we have shown and described the presently preferred embodiment of our invention, the invention is not limited thereto and may be otherwise variously practiced within the scope of the following claims:

We claim:

1. A flashlight comprising:

a) a flashlight head having a light emitting object positioned therein;

b) an electrically conducting battery chamber adapted to be removably attached to said flashlight head, said battery chamber adapted to receive and make an electrical connection with at least one cell; and c) an annular wave spring positioned between said electrically conducting battery chamber and said flashlight head whereby said wave spring is at least partially compressed when said battery chamber is attached to said flashlight head and an electrical connection is made between said at least one cell positioned in said battery chamber and said light emitting object through said wave spring at multiple contact points.

2. A flashlight according to claim 1 wherein said flashlight head further comprises a reflector.

3. A flashlight according to claim 1 wherein said light emitting object is an incandescent bulb.

4. A flashlight according to claim 1 wherein said light emitting object is a solid state device.

5. A flashlight according to claim 1 wherein said light emitting object is a light emitting diode (LED).

6. A flashlight according to claim 1 wherein said light emitting object is a high intensity white LED light source.

7. A flashlight according to claim 1 wherein said light emitting object comprises plural LED light sources.

8. A flashlight according to claim 1 wherein said battery chamber makes an electrical connection with a negative terminal of a cell through a negative terminal coil spring positioned in said electrically conducting battery chamber.

9. A flashlight according to claim 1 wherein said flashlight head further comprises a positive terminal coil spring located in a central portion thereof, said positive terminal coil spring making an electrical connection between a positive terminal of a cell positioned in said battery chamber and said light emitting object.

10. A flashlight according to claim 1 wherein said flashlight head and said battery chamber are each threaded and said flashlight head is removably attached to said battery chamber by screwing the flashlight head to the battery chamber.

11. A flashlight according to claim 1 wherein said flashlight head is removably attached to said battery chamber by means of a push and twist telescoping latch mechanism.

12. A flashlight according to claim 1 further comprising a metal ring member electrically connected to said light emitting object and in electrical contact with said wave spring.

13. A flashlight according to claim 1 further comprising an O-ring provided between said battery chamber and said flashlight head to provide a water resistant seal.

14. A flashlight according to claim 1 further comprising a flange on said battery chamber to prevent said chamber from being inserted to far into the flashlight head when attached thereto.

15. A flashlight according to claim 1 wherein said flashlight head is fabricated from a high strength polycarbonate material.

16. A flashlight according to claim 1 wherein said flashlight head is fabricated from an electrically conducting material.

17. A flashlight according to claim 16 wherein said flashlight head is fabricated from one of stainless steel and aluminum.

18. A flashlight according to claim 1 wherein said electrically conducting battery chamber is fabricated from one of stainless steel and aluminum.

19. A flashlight comprising:

a) a flashlight head having a light emitting object positioned therein;

b) an electrically conducting battery chamber adapted to be removably attached to said flashlight head, said battery chamber adapted to receive and make an electrical connection with at least one cell;

c) a wave spring positioned between said electrically conducting battery chamber and said flashlight head whereby said wave spring is at least partially compressed when said battery chamber is attached to said flashlight head and an electrical connection is made between said at least one cell positioned in said batten chamber and said light emitting object through said wave spring; and d) a circuit board member electrically connected to said light emitting object and in electrical contact with said wave spring.

20. A flashlight according to claim 19 wherein said circuit board member electrically connected to said light emitting object and is connected to a negative terminal of a cell in said battery chamber through said wave spring.

21. A flashlight according to claim 20 wherein said circuit board member is electrically connected to a positive terminal of a cell in said battery chamber through a coil spring.

22. A flashlight according to claim 20 wherein said circuit board member provides a constant current to said light emitting object.

* * * * *